US009534597B2

(12) United States Patent
Williamson et al.

(10) Patent No.: US 9,534,597 B2
(45) **Date of Patent: *Jan. 3, 2017**

(54) VANE PUMP WITH MULTIPLE CONTROL CHAMBERS

(71) Applicant: Magna Powertrain Inc., Concord (CA)

(72) Inventors: Matthew Williamson, Richmond Hill (CA); David R. Shulver, Richmond Hill (CA); Cezar Tanasuca, Richmond Hill (CA)

(73) Assignee: Magna Powertrain Inc., Concord (CA)

( * ) Notice: Subject to any disclaimer, the term of this patent is extended or adjusted under 35 U.S.C. 154(b) by 0 days.

This patent is subject to a terminal disclaimer.

(21) Appl. No.: 14/840,484

(22) Filed: Aug. 31, 2015

(65) Prior Publication Data

US 2015/0369240 A1 Dec. 24, 2015

Related U.S. Application Data

(63) Continuation of application No. 13/800,227, filed on Mar. 13, 2013, now Pat. No. 9,181,803, which is a (Continued)

(51) Int. Cl.
*F04C 14/18* (2006.01)
*F04C 2/00* (2006.01)
(Continued)

(52) U.S. Cl.
CPC ..... *F04C 2/3442* (2013.01); *F01C 20/18* (2013.01); *F04C 14/226* (2013.01)

(58) Field of Classification Search
CPC ..... F04C 2/344; F04C 2/3442; F04C 14/223; F04C 14/226
(Continued)

(56) References Cited

U.S. PATENT DOCUMENTS 3,067,693 A 12/1962 Lambeck
4,342,545 A * 8/1982 Schuster ..... F04C 14/226 418/26
(Continued)

FOREIGN PATENT DOCUMENTS

CA 2588817 A1 6/2006
DE 3613965 A1 10/1987
(Continued)

*Primary Examiner* — Peter J Bertheaud
(74) *Attorney, Agent, or Firm* — Harness, Dickey & Pierce, P.L.C.

(57) ABSTRACT

A variable capacity vane pump for an automobile includes a pump control ring positioned within the housing to move about a pivot. A rotor is positioned within a cavity of the control ring such that a position of the control ring determines an offset between a center of the cavity and an axis of rotation of the rotor. A first control chamber is provided between the pump housing and a first outer surface of the control ring. The first outer surface is positioned on an opposite side of the control ring as the working fluid chambers within the cavity. A second control chamber is provided between the pump housing and a second outer surface of the control ring. A return spring biases the control ring toward a position of maximum volumetric capacity against the forces created by the pressurized fluid within the first and second control chambers.

8 Claims, 11 Drawing Sheets

Related U.S. Application Data continuation-in-part of application No. 13/686,680, filed on Nov. 27, 2012, now Pat. No. 8,651,825, which is a continuation of application No. 12/879,406, filed on Sep. 10, 2010, now Pat. No. 8,317,486, which is a continuation of application No. 11/720,787, filed as application No. PCT/CA2005/001946 on Dec. 21, 2005, now Pat. No. 7,794,217.

(60) Provisional application No. 60/639,185, filed on Dec. 22, 2004.

(51) Int. Cl.
*F01C 20/18* (2006.01)
*F04C 14/22* (2006.01)
*F04C 2/344* (2006.01)

(58) Field of Classification Search
USPC ..... 417/213, 220; 418/1, 24, 25, 26, 27, 30
See application file for complete search history.

(56) References Cited

U.S. PATENT DOCUMENTS 4,421,462 A 12/1983 Ohe
4,437,819 A 3/1984 Merz
4,531,893 A * 7/1985 Okoh ..... F04C 2/3442 417/220
4,538,974 A 9/1985 Stich et al.
4,558,998 A 12/1985 Kiyoshige et al.
4,678,412 A 7/1987 Dantlgraber
4,679,995 A 7/1987 Bristow
4,829,769 A 5/1989 Hiramatsu
5,090,881 A 2/1992 Suzuki et al.
5,178,525 A 1/1993 Murota
5,222,886 A 6/1993 Fischer et al.
5,273,408 A 12/1993 Yuge
5,366,354 A 11/1994 Yuge
5,435,698 A 7/1995 Phillips
5,538,400 A 7/1996 Konishi et al.
5,562,432 A 10/1996 Semba et al.
5,752,815 A 5/1998 Muller
5,800,131 A 9/1998 Lehmann et al.
6,155,797 A 12/2000 Kazuyoshi
6,352,415 B1 3/2002 Uchino
6,457,946 B2 10/2002 Gretzschel et al.
6,470,992 B2 10/2002 Nissen et al.
6,530,752 B2 3/2003 Oba et al.
6,558,132 B2 5/2003 Hanggi
6,688,862 B2 2/2004 Jeronymo et al.
6,722,856 B2 4/2004 Schneider
6,763,797 B1 7/2004 Staley et al.
6,790,013 B2 9/2004 Hunter et al.
6,913,446 B2 7/2005 Nissen et al.
7,018,178 B2 3/2006 Hunter et al.
7,396,214 B2 7/2008 Hunter et al.
7,549,848 B2 6/2009 Scholl
7,614,858 B2 11/2009 Tanasuca
7,726,948 B2 6/2010 Hunter et al.
7,785,087 B2 8/2010 Schneider
7,794,217 B2 * 9/2010 Williamson ..... F04C 2/04 417/220
7,798,790 B2 * 9/2010 Lutoslawski ..... F04C 2/3442 417/220
7,931,450 B2 4/2011 Ueki et al.
8,047,822 B2 * 11/2011 Shulver ..... F01M 1/16 417/220
8,057,201 B2 * 11/2011 Shulver ..... F04C 2/3442 417/220
8,079,826 B2 12/2011 Shulver et al.
8,317,486 B2 * 11/2012 Williamson ..... F04C 2/04 417/213
8,496,445 B2 * 7/2013 Shulver ..... F01M 1/16 417/212
8,651,825 B2 * 2/2014 Williamson ..... F04C 2/04 417/220
9,181,803 B2 * 11/2015 Williamson ..... F01C 20/18
2001/0036412 A1 11/2001 Konishi
2002/0114708 A1 8/2002 Hunter et al.
2003/0059313 A1 3/2003 Hanggi
2003/0231965 A1 12/2003 Hunter et al.
2004/0144354 A1 7/2004 Staley et al.
2007/0224067 A1 9/2007 Arnold et al.
2008/0107554 A1 5/2008 Shulver et al.
2008/0175724 A1 7/2008 Shulver et al.
2008/0247894 A1 10/2008 Lutoslawski et al.
2009/0269232 A1 10/2009 Williamson et al.
2010/0028171 A1 2/2010 Shulver et al.
2010/0221126 A1 9/2010 Tanasuca et al.
2010/0226799 A1 9/2010 Watanabe et al.
2010/0232989 A1 9/2010 Watanabe et al.
2011/0123379 A1 5/2011 Saga et al.
2011/0165010 A1 7/2011 Iijima
2011/0189043 A1 8/2011 Watanabe et al.
2011/0194967 A1 8/2011 Watanabe et al.
2011/0300015 A1 12/2011 Kirchner et al.
2012/0213654 A1 8/2012 Zwickler et al.
2014/0199197 A1 7/2014 Bowing et al.

FOREIGN PATENT DOCUMENTS

EP 49838 A1 4/1982
EP 0171182 A1 2/1986
EP 0171183 A1 2/1986
EP 0210786 A1 2/1987
EP 1350957 A1 10/2003
EP 2253847 A1 11/2010
GB 2363429 A 12/2001
JP 56143384 11/1981
JP 6133272 9/1986
JP 06093978 A 4/1994
JP 7293455 11/1995
JP 10205461 8/1998
JP 2870602 B2 3/1999
JP 3275994 B2 4/2002
WO WO-2006045190 A1 5/2006

* cited by examiner

VANE PUMP WITH MULTIPLE CONTROL CHAMBERS

CROSS-REFERENCE TO RELATED APPLICATIONS

This application is a continuation of U.S. patent application Ser. No. 13/800,227, filed on Mar. 13, 2013, which is a continuation-in-part of U.S. patent application Ser. No. 13/686,680, filed on Nov. 27, 2012, now U.S. Pat. No. 8,651,825, issued Feb. 2, 2014, which is a continuation of U.S. patent application Ser. No. 12/879,406 filed on Sep. 10, 2010, now U.S. Pat. No. 8,317,486, issued Nov. 27, 2012, which is a continuation of U.S. patent application Ser. No. 11/720,787, filed Jun. 4, 2007, now U.S. Pat. No. 7,794,217, issued Sep. 14, 2010, which is a National Stage of International Application No. PCT/CA2005/001946, filed Dec. 21, 2005, which claims the benefit of U.S. Provisional Application No. 60/639,185, filed on Dec. 22, 2004. The entire disclosures of each of the above applications are incorporated herein by reference.

FIELD

The present invention relates to a variable capacity vane pump. More specifically, the present invention relates to a variable capacity vane pump including multiple control chambers. Different sources of pressurized fluid may be provided to the control chambers to control the pump displacement.

BACKGROUND

Variable capacity vane pumps are well known and can include a capacity adjusting element, in the form of a pump control ring that can be moved to alter the rotor eccentricity of the pump and hence alter the volumetric capacity of the pump. If the pump is supplying a system with a substantially constant orifice size, such as an automobile engine lubrication system, changing the output flow of the pump is equivalent to changing the pressure produced by the pump.

Having the ability to alter the volumetric capacity of the pump to maintain an equilibrium pressure is important in environments such as automotive lubrication pumps, wherein the pump will be operated over a range of operating speeds. In such environments, to maintain an equilibrium pressure it is known to employ a feedback supply of the working fluid (e.g. lubricating oil) from the output of the pump to a control chamber adjacent the pump control ring, the pressure in the control chamber acting to move the control ring, typically against a biasing force from a return spring, to alter the capacity of the pump.

When the pressure at the output of the pump increases, such as when the operating speed of the pump increases, the increased pressure is applied to the control ring to overcome the bias of the return spring and to move the control ring to reduce the capacity of the pump, thus reducing the output flow and hence the pressure at the output of the pump.

Conversely, as the pressure at the output of the pump drops, such as when the operating speed of the pump decreases, the decreased pressure applied to the control chamber adjacent the control ring allows the bias of the return spring to move the control ring to increase the capacity of the pump, raising the output flow and hence pressure of the pump. In this manner, an equilibrium pressure is obtained at the output of the pump.

The equilibrium pressure is determined by the area of the control ring against which the working fluid in the control chamber acts, the pressure of the working fluid supplied to the chamber and the bias force generated by the return spring.

Conventionally, the equilibrium pressure is selected to be a pressure which is acceptable for the expected operating range of the engine and is thus somewhat of a compromise as, for example, the engine may be able to operate acceptably at lower operating speeds with a lower working fluid pressure than is required at higher engine operating speeds. In order to prevent undue wear or other damage to the engine, the engine designers will select an equilibrium pressure for the pump which meets the worst case (high operating speed) conditions. Thus, at lower speeds, the pump will be operating at a higher capacity than necessary for those speeds, wasting energy pumping the surplus, unnecessary, working fluid.

It is desired to have a variable capacity vane pump which can provide at least two selectable equilibrium pressures in a reasonably compact pump housing. It is also desired to have a variable capacity vane pump wherein reaction forces on the pivot pin for the pump control ring are reduced.

SUMMARY

It is an object of the present invention to provide a novel variable capacity vane pump which obviates or mitigates at least one disadvantage of the prior art.

A variable capacity vane pump includes a first control chamber between a pump casing and a first portion of a pump control ring. The first portion of the control ring circumferentially extends on either side of a pivot pin. A second control chamber is provided between the pump casing and a second portion of the pump control ring. The first and second control chambers are operable to receive pressurized fluid to create a force to move the pump control ring to reduce the volumetric capacity of the pump. A return spring biases the pump ring toward a position of maximum volumetric capacity.

A variable volumetric capacity vane pump includes a pump casing including a pump chamber having an inlet port and an outlet port. A pump control ring pivots within the pump chamber to alter the volumetric capacity of the pump. A rotor is rotatably mounted within the pump control ring and includes slots in receipt of slidable vanes. First, second, and third control chambers are formed between the pump casing and an outer surface of the pump control ring. The first and second control chambers are selectively operable to receive pressurized fluid to create forces to move the pump control ring to reduce the volumetric capacity of the pump. The third chamber is in constant receipt of pressurized fluid from the outlet of the pump. A return spring is positioned within the casing to act between the pump ring and the casing to bias the pump ring toward a position of maximum volumetric capacity and act against the force generated by the pressurized fluid within the first and second control chambers.

DRAWINGS

Preferred embodiments of the present invention will now be described, by way of example only, with reference to the attached Figures, wherein.

Figure 6:
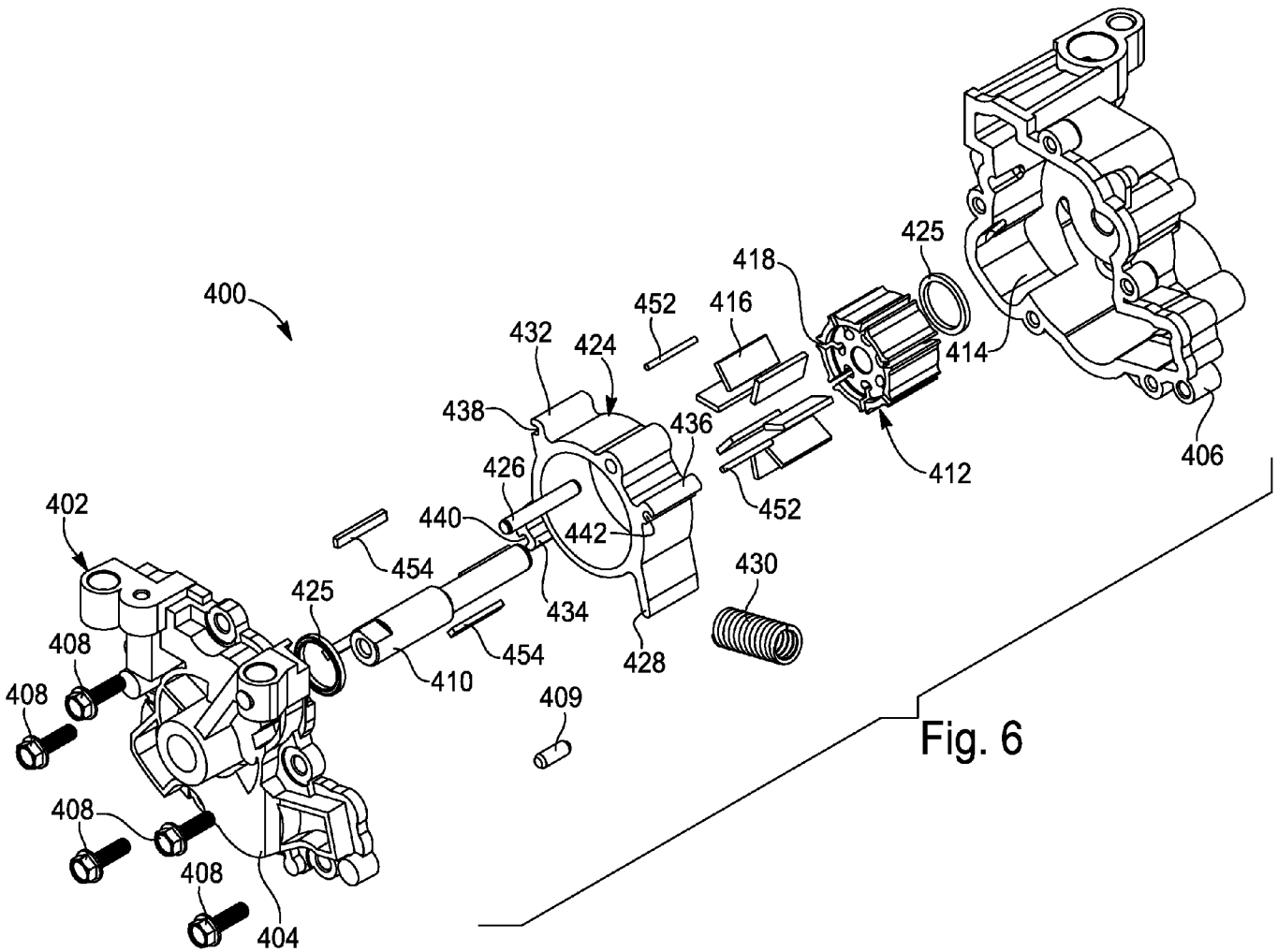
Figure 7:
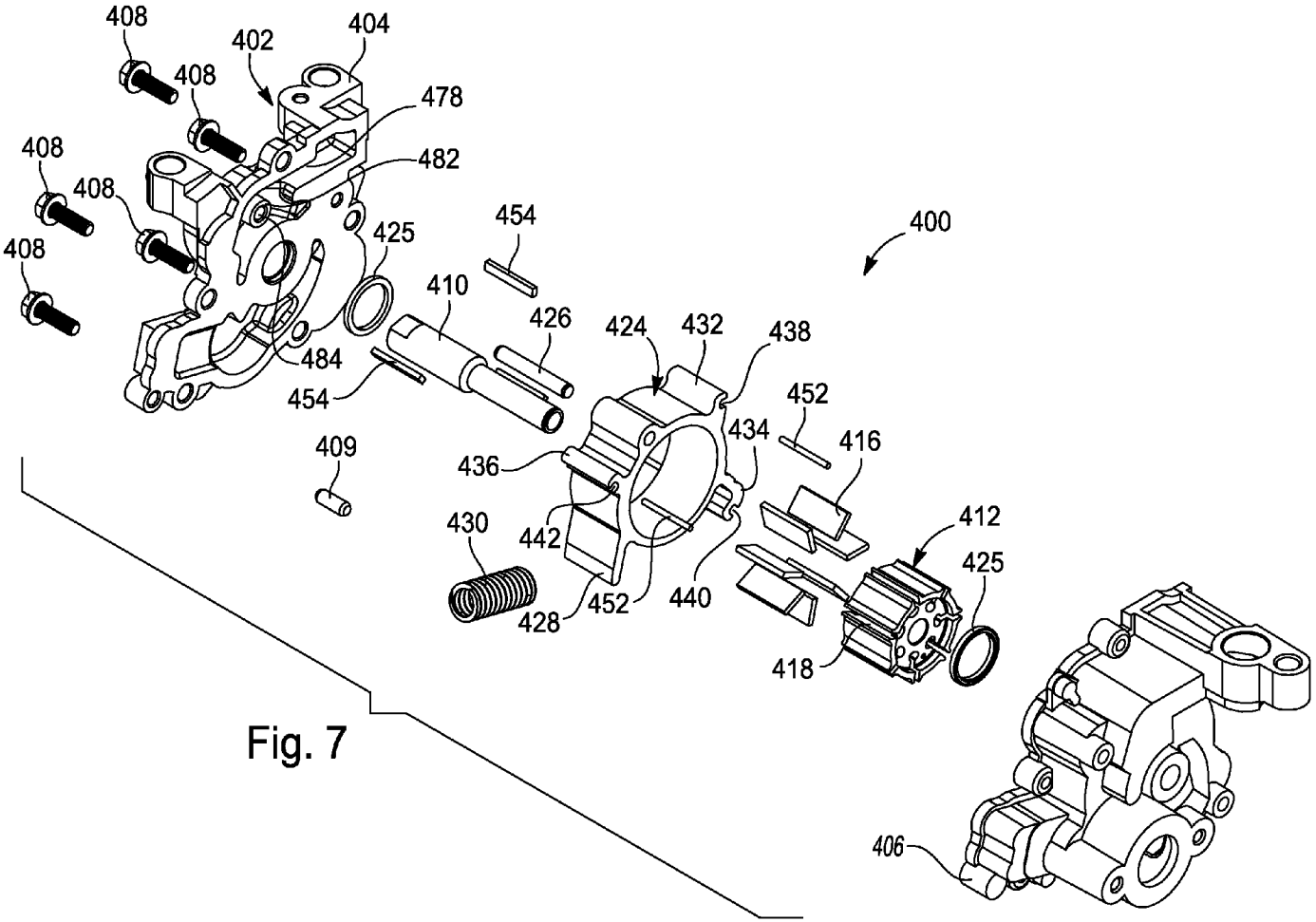
Figure 8:
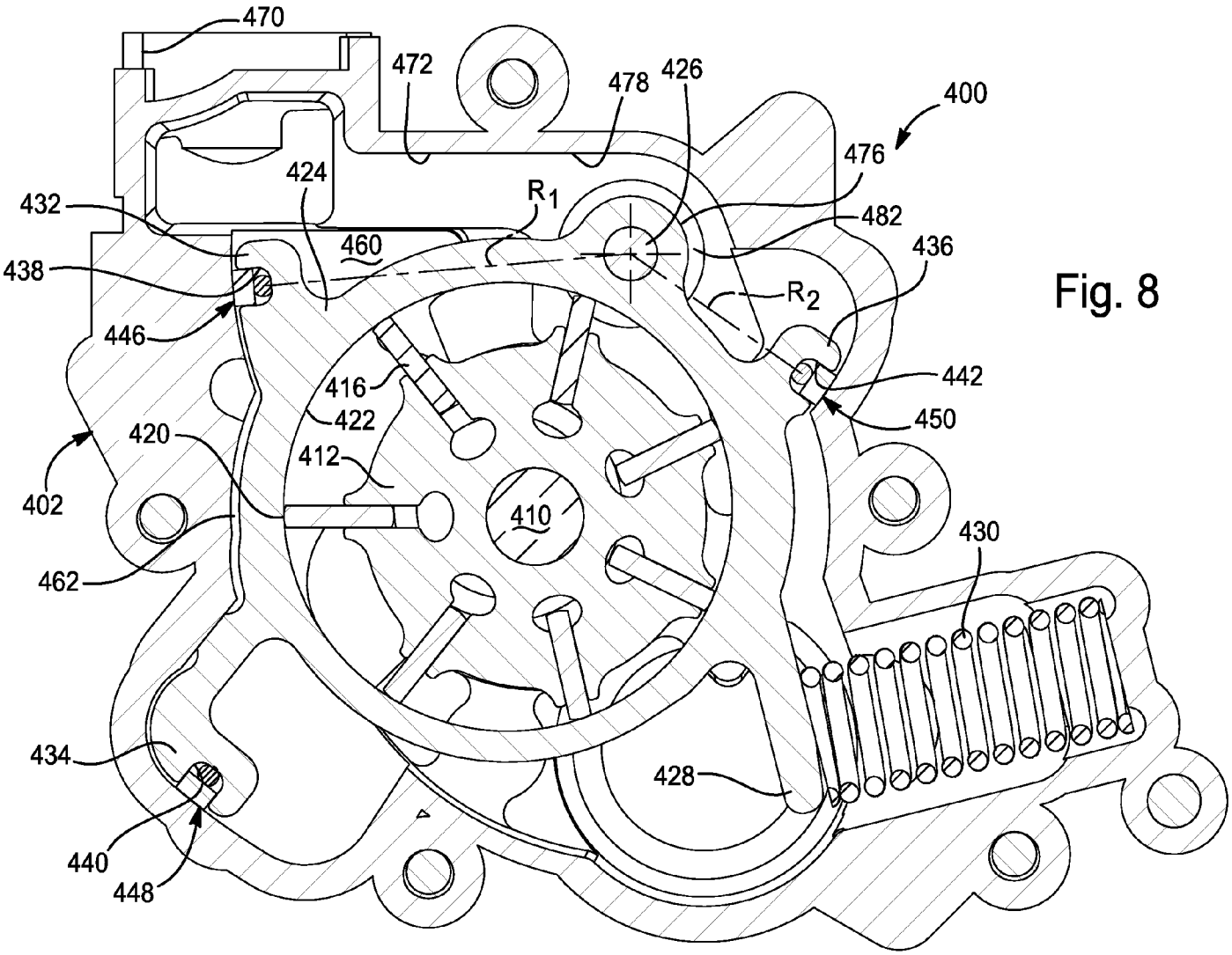
Figure 9:
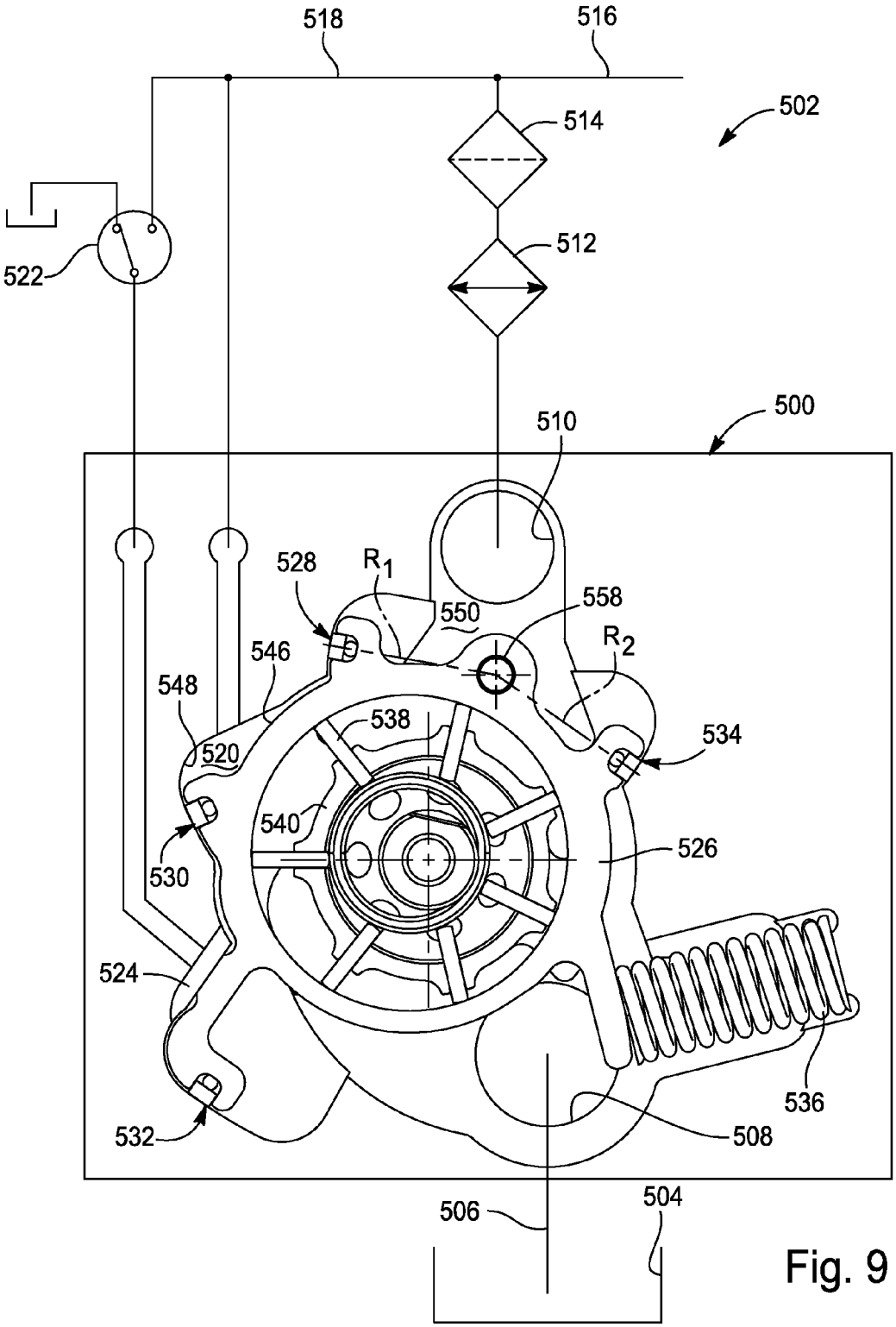
Figure 10:
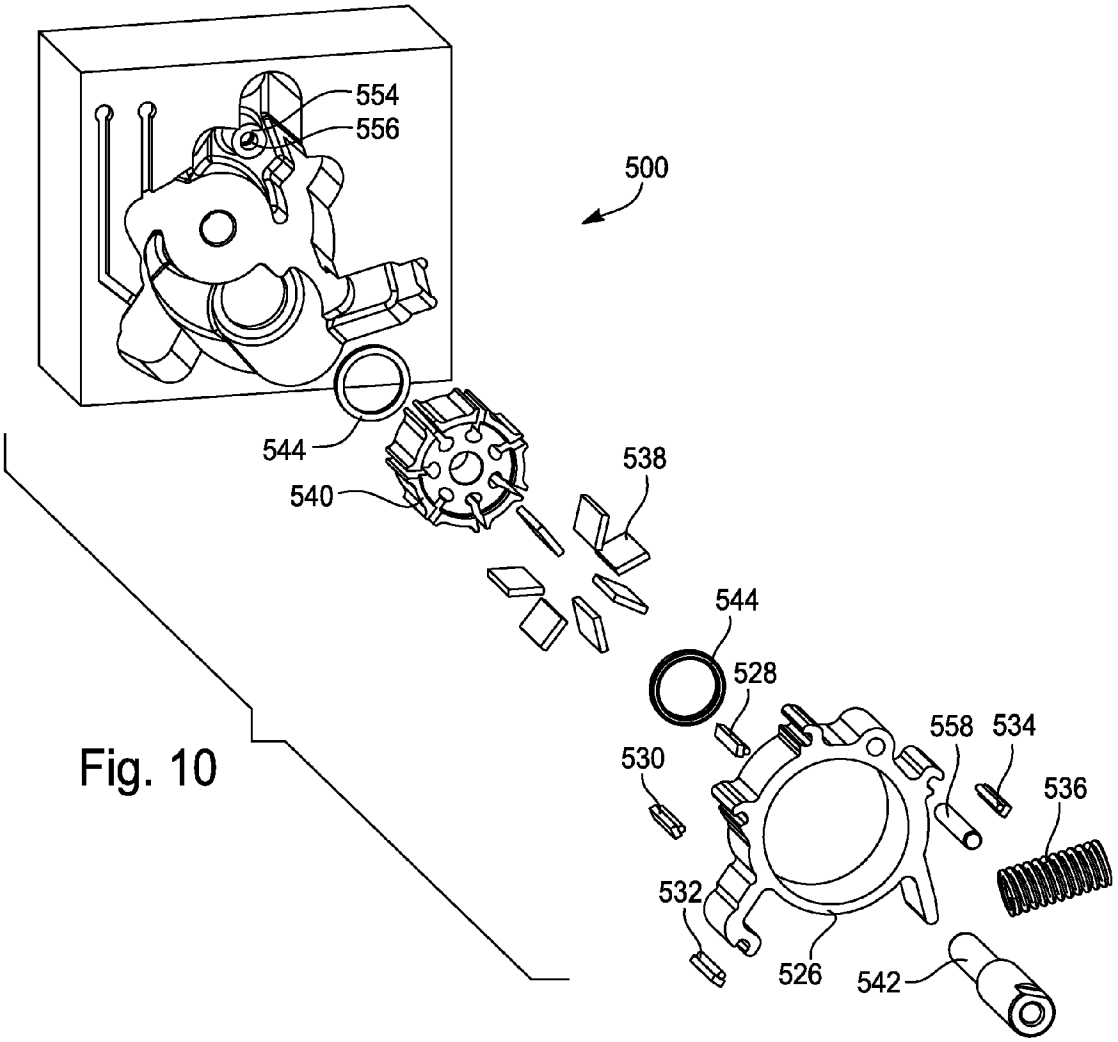
Figure 11:
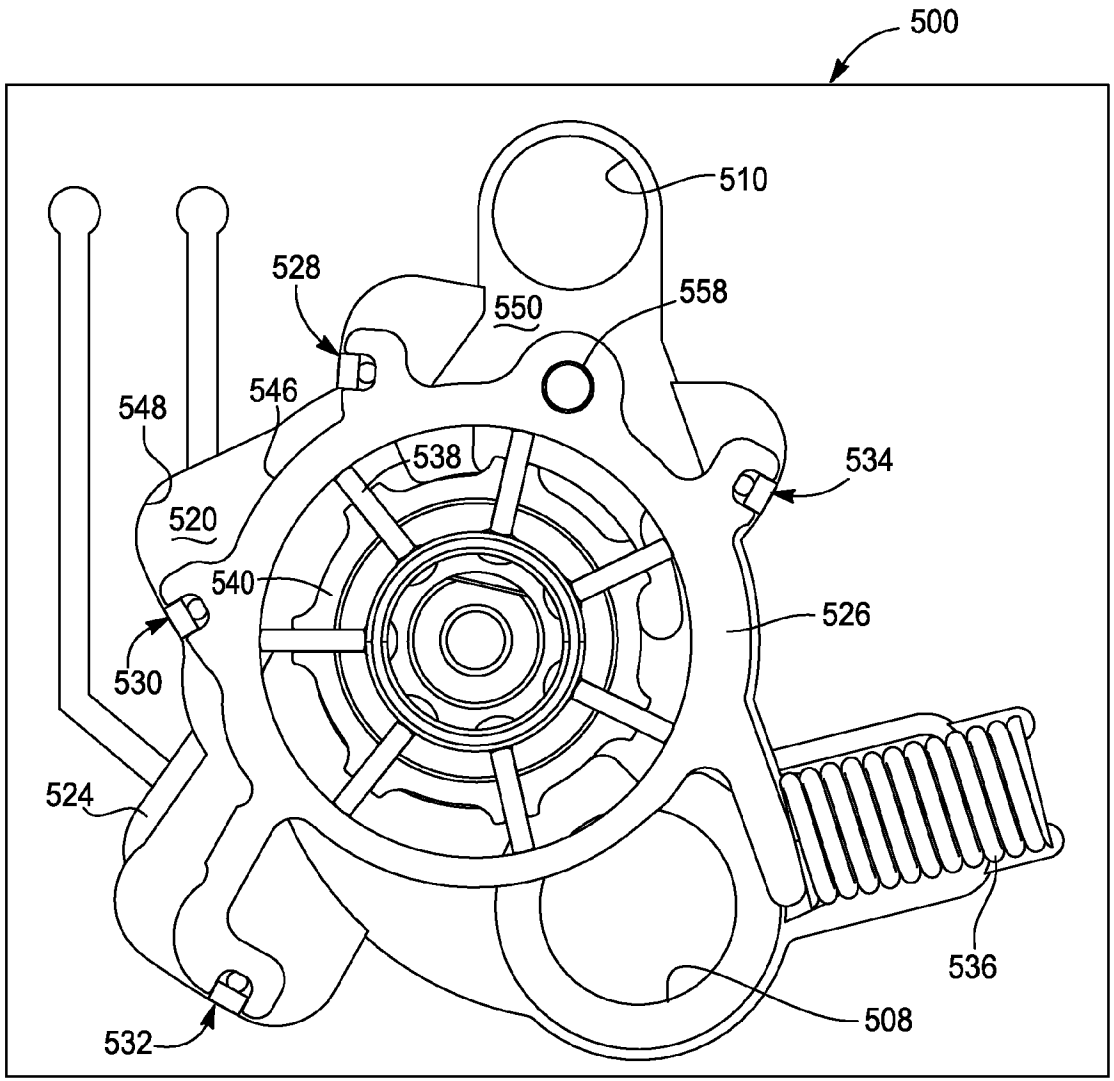

FIG. 6 provides an exploded perspective view of an alternate variable displacement pump;

FIG. 7 provides another exploded perspective view of the pump depicted in FIG. 6;

FIG. 8 is a cross-sectional view taken through the pump depicted in FIGS. 6 and 7;

FIG. 9 is a schematic including a cross-sectional view of another alternate variable capacity vane pump;

FIG. 10 is an exploded perspective view of the vane pump depicted in FIG. 9; and FIG. 11 is a partial plan view of the pump depicted in FIGS. 9 and 10 having the pump control ring positioned at a location of minimum pump volumetric capacity.

DETAILED DESCRIPTION

Figure 1:
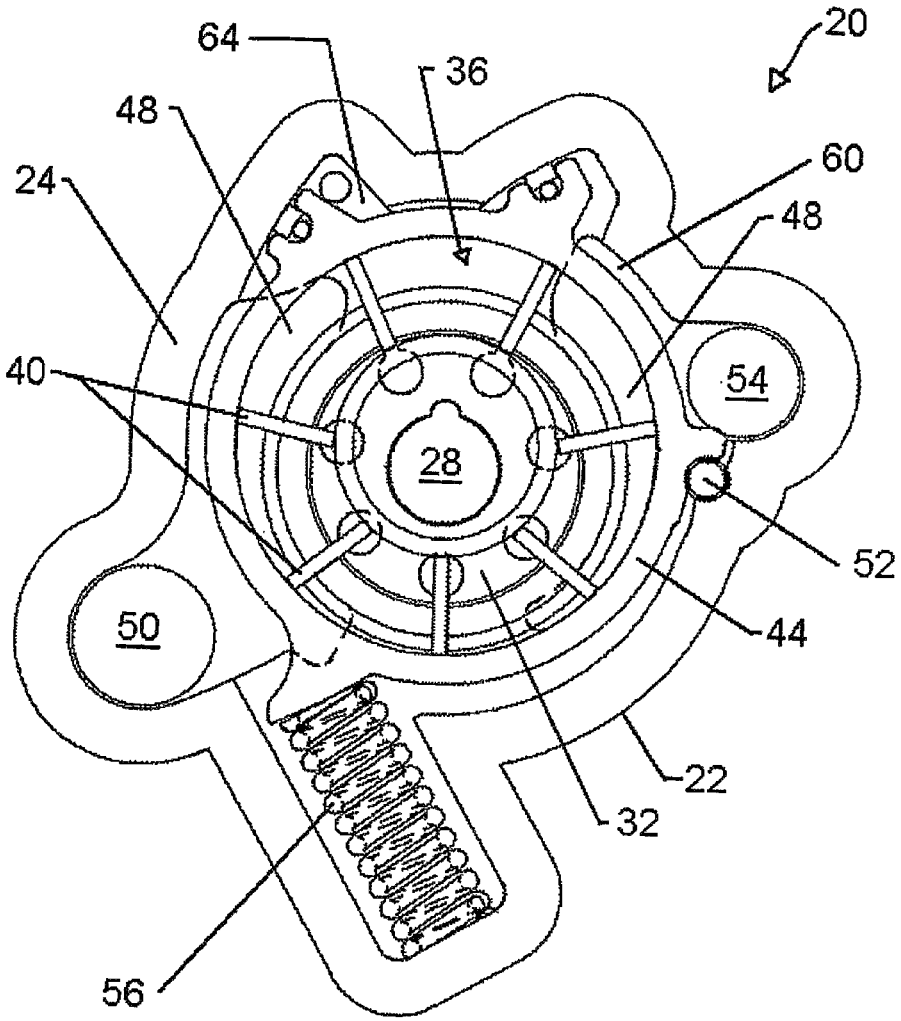
FIG. 1 is a front view of a variable capacity vane pump in accordance with the present invention with the control ring positioned for maximum rotor eccentricity.
Figure 2:
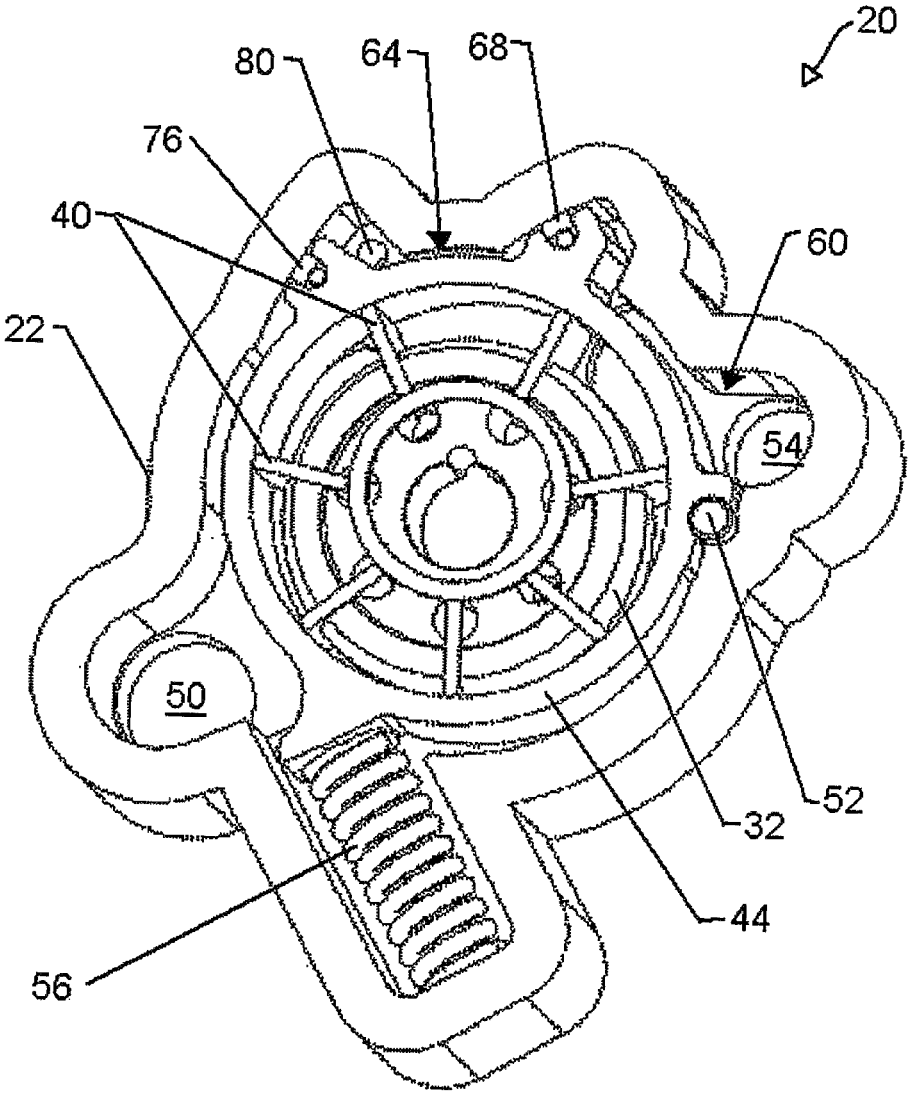
FIG. 2 is a front perspective view of the pump of FIG. 1 with the control ring positioned for maximum rotor eccentricity.
Figure 3:
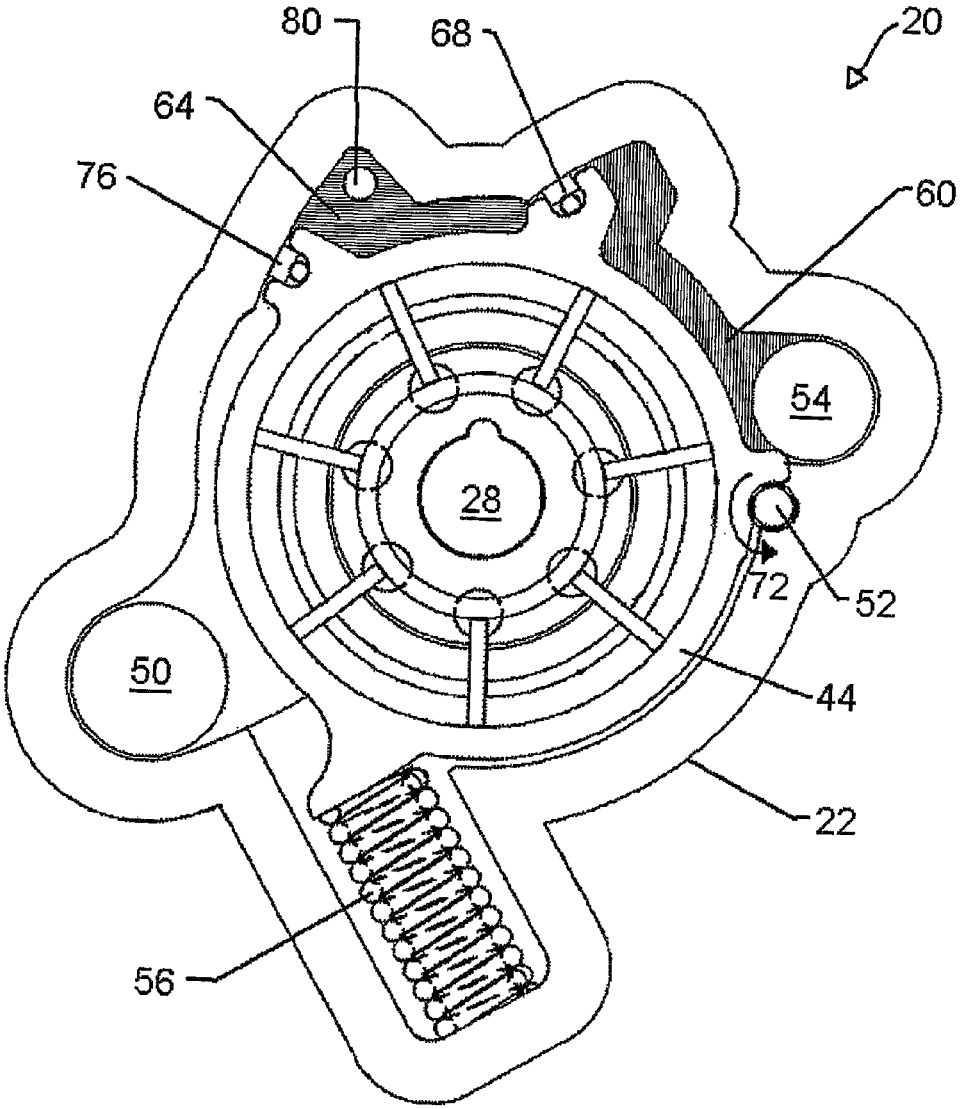
FIG. 3 is the a front view of the pump of FIG. 1 with the control ring position for minimum eccentricity and wherein the areas of the pump control chambers are in hatched line.

A variable capacity vane pump in accordance with an embodiment of the present invention is indicated generally at 20 in FIGS. 1, 2 and 3.

Referring now to FIGS. 1, 2 and 3, pump 20 includes a housing or casing 22 with a front face 24 which is sealed with a pump cover (not shown) and a suitable gasket, to an engine (not shown) or the like for which pump 20 is to supply pressurized working fluid.

Pump 20 includes an input member or drive shaft 28 which is driven by any suitable means, such as the engine or other mechanism to which the pump is to supply working fluid, to operate pump 20. As drive shaft 28 is rotated, a pump rotor 32 located within a pump chamber 36 is turned with drive shaft 28. A series of slidable pump vanes 40 rotate with rotor 32, the outer end of each vane 40 engaging the inner surface of a pump control ring 44, which forms the outer wall of pump chamber 36. Pump chamber 36 is divided into a series of working fluid chambers 48, defined by the inner surface of pump control ring 44, pump rotor 32 and vanes 40. The pump rotor 32 has an axis of rotation that is eccentric from the center of the pump control ring 44.

Pump control ring 44 is mounted within casing 22 via a pivot pin 52 which allows the center of pump control ring 44 to be moved relative to the center of rotor 32. As the center of pump control ring 44 is located eccentrically with respect to the center of pump rotor 32 and each of the interior of pump control ring 44 and pump rotor 32 are circular in shape, the volume of working fluid chambers 48 changes as the chambers 48 rotate around pump chamber 36, with their volume becoming larger at the low pressure side (the left hand side of pump chamber 36 in FIG. 1) of pump 20 and smaller at the high pressure side (the right hand side of pump chamber 36 in FIG. 1) of pump 20. This change in volume of working fluid chambers 48 generates the pumping action of pump 20, drawing working fluid from an inlet port 50 and pressurizing and delivering it to an outlet port 54.

By moving pump control ring 44 about pivot pin 52 the amount of eccentricity, relative to pump rotor 32, can be changed to vary the amount by which the volume of working fluid chambers 48 change from the low pressure side of pump 20 to the high pressure side of pump 20, thus changing the volumetric capacity of the pump. A return spring 56 biases pump control ring 44 to the position, shown in FIGS. 1 and 2, wherein the pump has a maximum eccentricity.

As mentioned above, it is known to provide a control chamber adjacent a pump control ring and a return spring to move the pump ring of a variable capacity vane pump to establish an equilibrium output flow, and its related equilibrium pressure.

However, in accordance with the present invention, pump 20 includes two control chambers 60 and 64, best seen in FIG. 3, to control pump ring 44. Control chamber 60, the rightmost hatched area in FIG. 3, is formed between pump casing 22, pump control ring 44, pivot pin 52 and a resilient seal 68, mounted on pump control ring 44 and abutting casing 22. In the illustrated embodiment, control chamber 60 is in direct fluid communication with pump outlet 54 such that pressurized working fluid from pump 20 which is supplied to pump outlet 54 also fills control chamber 60.

As will be apparent to those of skill in the art, control chamber 60 need not be in direct fluid communication with pump outlet 54 and can instead be supplied from any suitable source of working fluid, such as from an oil gallery in an automotive engine being supplied by pump 20.

Pressurized working fluid in control chamber 60 acts against pump control ring 44 and, when the force on pump control ring 44 resulting from the pressure of the pressurized working is sufficient to overcome the biasing force of return spring 56, pump control ring 44 pivots about pivot pin 52, as indicated by arrow 72 in FIG. 3, to reduce the eccentricity of pump 20. When the pressure of the pressurized working fluid is not sufficient to overcome the biasing force of return spring 56, pump control ring 44 pivots about pivot pin 52, in the direction opposite to that indicated by arrow 72, to increase the eccentricity of pump 20.

Pump 20 further includes a second control chamber 64, the leftmost hatched area in FIG. 3, which is formed between pump casing 22, pump control ring 44, resilient seal 68 and a second resilient seal 76. Resilient seal 76 abuts the wall of pump casing 22 to separate control chamber 64 from pump inlet 50 and resilient seal 68 separates chamber 64 from chamber 60.

Control chamber 64 is supplied with pressurized working fluid through a control port 80. Control port 80 can be supplied with pressurized working fluid from any suitable source, including pump outlet 54 or a working fluid gallery in the engine or other device supplied from pump 20. A control mechanism (not shown) such as a solenoid operated valve or diverter mechanism is employed to selectively supply working fluid to chamber 64 through control port 80, as discussed below. As was the case with control chamber 60, pressurized working fluid supplied to control chamber 64 from control port 80 acts against pump control ring 44.

As should now be apparent, pump 20 can operate in a conventional manner to achieve an equilibrium pressure as pressurized working fluid supplied to pump outlet 54 also fills control chamber 60. When the pressure of the working fluid is greater than the equilibrium pressure, the force created by the pressure of the supplied working fluid over the portion of pump control ring 44 within chamber 60 will overcome the force of return spring 56 to move pump ring 44 to decrease the volumetric capacity of pump 20. Conversely, when the pressure of the working fluid is less than the equilibrium pressure, the force of return spring 56 will exceed the force created by the pressure of the supplied working fluid over the portion of pump control ring 44 within chamber 60 and return spring 56 will to move pump ring 44 to increase the volumetric capacity of pump 20.

However, unlike with conventional pumps, pump 20 can be operated at a second equilibrium pressure. Specifically, by selectively supplying pressurized working fluid to control chamber 64, via control port 80, a second equilibrium pressure can be selected. For example, a solenoid-operated valve controlled by an engine control system, can supply pressurized working fluid to control chamber 64, via control port 80, such that the force created by the pressurized working fluid on the relevant area of pump control ring 44 within chamber 64 is added to the force created by the pressurized working fluid in control chamber 60, thus moving pump control ring 44 further than would otherwise be the case, to establish a new, lower, equilibrium pressure for pump 20.

As an example, at low operating speeds of pump 20, pressurized working fluid can be provided to both chambers 60 and 64 and pump ring 44 will be moved to a position wherein the capacity of the pump produces a first, lower, equilibrium pressure which is acceptable at low operating speeds.

When pump 20 is driven at higher speeds, the control mechanism can operate to remove the supply of pressurized working fluid to control chamber 64, thus moving pump ring 44, via return spring 56, to establish a second equilibrium pressure for pump 20, which second equilibrium pressure is higher than the first equilibrium pressure.

While in the illustrated embodiment chamber 60 is in fluid communication with pump outlet 54, it will be apparent to those of skill in the art that it is a simple matter, if desired, to alter the design of control chamber 60 such that it is supplied with pressurized working fluid from a control port, similar to control port 80, rather than from pump outlet 54. In such a case, a control mechanism (not shown) such as a solenoid operated valve or a diverter mechanism can be employed to selectively supply working fluid to chamber 60 through the control port. As the area of control ring 44 within each of control chambers 60 and 64 differs, by selectively applying pressurized working fluid to control chamber 60, to control chamber 64 or to both of control chambers 60 and 64 three different equilibrium pressures can be established, as desired.

As will also be apparent to those of skill in the art, should additional equilibrium pressures be desired, pump casing 22 and pump control ring 44 can be fabricated to form one or more additional control chambers, as necessary.

Figure 4:
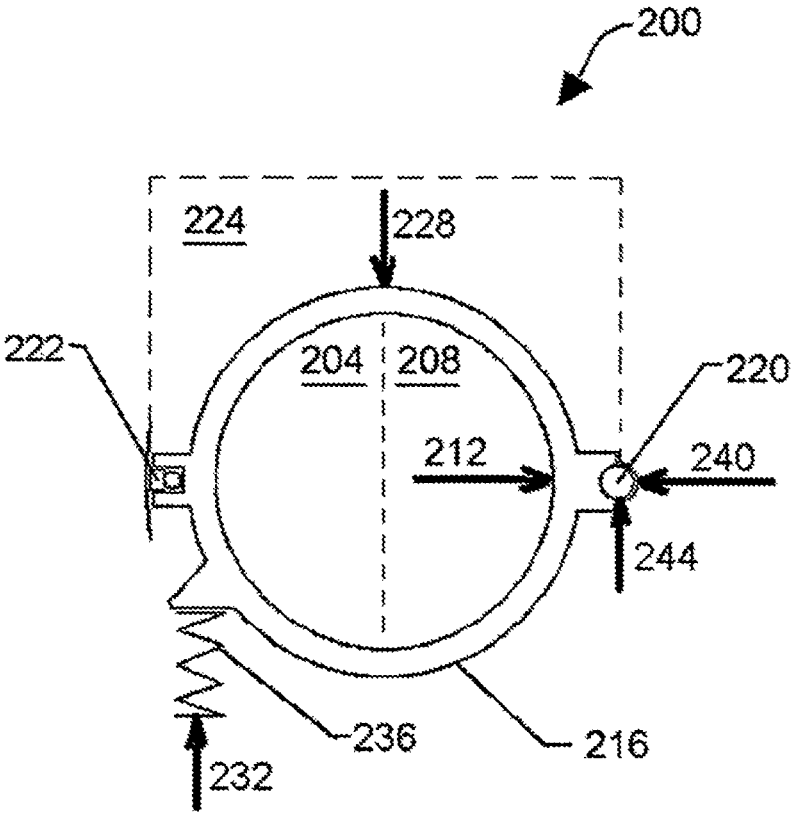
Fig. 4 (prior art)
FIG. 4 shows a schematic representation of a prior art variable capacity vane pump.

Pump 20 offers a further advantage over conventional vane pumps such as pump 200 shown in FIG. 4. In conventional vane pumps such as pump 200, the low pressure fluid 204 in the pump chamber exerts a force on pump ring 216 as does the high pressure fluid 208 in the pump chamber. These forces result in a significant net force 212 on the pump control ring 216 and this force is largely carried by pivot pin 220 which is located at the point where force 212 acts.

Further, the high pressure fluid within the outlet port 224 (indicated in dashed line), acting over the area of pump ring 216 between pivot pin 220 and resilient seal 222, also results in a significant force 228 on pump control ring 216. While force 228 is somewhat offset by the force 232 of return spring 236, the net of forces 228 less force 232 can still be significant and this net force is also largely carried by pivot pin 220.

Thus pivot pin 220 carries large reaction forces 240 and 244, to counter net forces 212 and 228 respectively, and these forces can result in undesirable wear of pivot pin 220 over time and/or "stiction" of pump control ring 216, wherein it does not pivot smoothly about pivot pin 220, making fine control of pump 200 more difficult to achieve.

Figure 5:
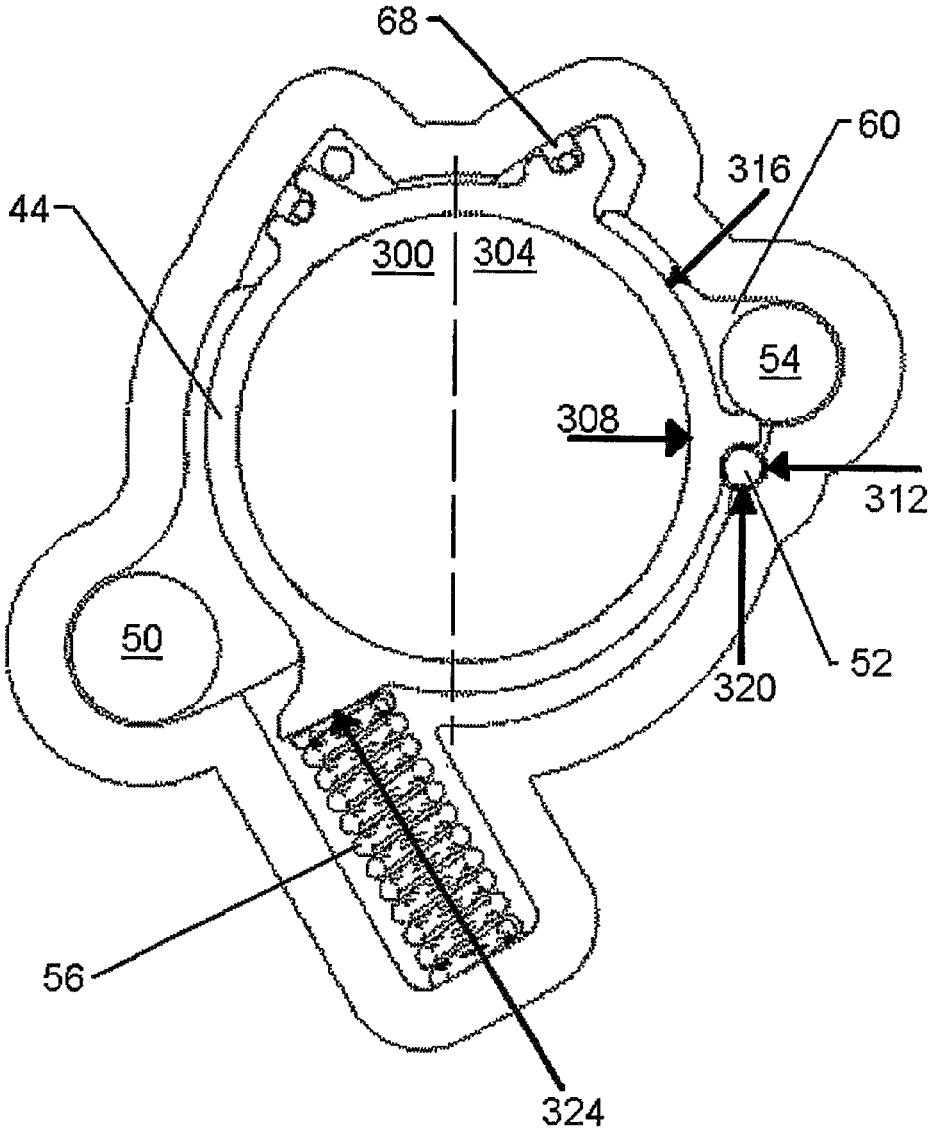
FIG. 5 shows a front view of the pump of FIG. 1 wherein the rotor and vanes have been removed to illustrate the forces within the pump.

As shown in FIG. 5, the low pressure side 300 and high pressure side 304 of pump 20 result in a net force 308 which is applied to pump control ring 44 almost directly upon pivot pin 52 and a corresponding reaction force, shown as a horizontal (with respect to the orientation shown in the Figure) force 312, is produced on pivot pin 52. Unlike conventional variable capacity vane pumps such as pump 200, in pump 20 resilient seal 68 is located relatively closely to pivot pin 52 to reduce the area of pump control ring 44 upon which the pressurized working fluid in control chamber 60 acts and thus to significantly reduce the magnitude of the force 316 produced on pump control ring 44.

Further, control chamber 60 is positioned such that force 316 includes a horizontal component, which acts to oppose force 308 and thus reduce reaction force 312 on pivot pin 52. The vertical (with respect to the orientation shown in the Figure) component of force 316 does result in a vertical reaction force 320 on pivot pin 52 but, as mentioned above, force 316 is of less magnitude than would be the case with conventional pumps and the vertical reaction force 320 is also reduced by a vertical component of the biasing force 324 produced by return spring 56

Thus, the unique positioning of control chamber 60 and return spring 56, with respect to pivot pin 52, results in reduced reaction forces on pivot pin 52 and can improve the operating lifetime of pump 20 and can reduce "stiction" of pump control ring 44 to allow smoother control of pump 20. As will be apparent to those of skill in the art, this unique positioning is not limited to use in variable capacity vane pumps with two or more equilibrium pressures and can be employed with variable capacity vane pumps with single equilibrium pressures.

FIGS. 6-8 depict another variable capacity vane pump constructed in accordance with the teachings of the present disclosure and identified at reference numeral 400. Pump 400 includes a housing 402 including a first cover 404 fixed to a second cover 406 by a plurality of fasteners 408. A dowel pin 409 aligns the first and second covers. Pump 400 includes an input or a drive shaft 410 having at least one end protruding from housing 402. Drive shaft 410 may be driven by any suitable means such as an internal combustion engine. A rotor 412 is fixed for rotation with drive shaft 410 and positioned within a pumping chamber 414 defined by pump housing 402. Vanes 416 are slidably engaged within radially extending slots 418 defined by rotor 412. Outer surfaces 420 of each vane slidably engage a sealing surface 422 of a moveable pump control ring 424. Sealing surface 422 is shaped as a circular cylinder having a center which may be offset from a center of drive shaft 410. Retaining rings 425 limit the inboard extent to which the vanes may slide to maintain engagement of surfaces 420 with surface 422.

Pump control ring 424 is positioned within chamber 414 and is pivotally coupled to housing 402 via a pivot pin 426. Pump control ring 424 includes a radially outwardly extending arm 428. A bias spring 430 engages arm 428 to urge pump control ring 424 toward a position of maximum capacity.

Pump control ring 424 includes first through third projections identified at reference numerals 432, 434, 436. Each of the first through third projections includes an associated groove 438, 440, 442. A first seal assembly 446 is positioned within first groove 438 to sealingly engage housing 402. A second seal assembly 448 is positioned within second groove 440 to sealingly engage a different portion of housing 402. A third seal assembly 450 is positioned within third groove 442. Third seal assembly 450 sealingly engages another portion of housing 402. Each seal assembly includes a cylindrically shaped first elastomer 452 engaging a second elastomer 454 having a substantially rectangular cross-section. Each seal assembly is positioned within an associated seal groove. A first chamber 460 extends between first seal assembly 446 and third seal assembly 450 and between an outer surface of pump control ring 424 and housing 402. A second chamber 462 is defined between first seal assembly 446 and second seal assembly 448, as well as the other surface of pump control ring 424 and housing 402.

First seal assembly 446 is positioned relative to pivot pin 426 to define a first radius or moment arm $R_1$. The position of third seal assembly 450 also defines a radius or moment arm $R_2$ in relation to the center of pivot pin 426. The length of moment arm $R_1$ defined by first seal assembly 446 is greater than the length of moment arm $R_2$ defined by the position of third seal assembly 450 such that a turning moment is generated when first chamber 460 is pressurized. The turning moment urges pump control ring 424 to oppose the force applied by bias spring 430. First seal assembly 446 is circumferentially spaced apart from third seal assembly 450 an angle greater than 100 degrees with the angle vertex being the center of the pump control ring cavity bounded by surface 422. FIG. 8 depicts this angle as approximately 117 degrees. It should be appreciated that the position of first seal assembly 446 and second seal assembly 448 relative to pivot pin 426 also causes the pressurized fluid entering the second chamber to impart a moment of pump control ring 424 that opposes the force applied by bias ring 430.

An outlet port 470 extends through housing 402 to allow pressurized fluid to exit pump 400. An enlarged discharge cavity 472 is defined by housing 402. Enlarged discharge cavity 472 extends from third seal assembly 450 to outlet port 470. It should be appreciated that enlarged discharge cavity extends on either side of pivot pin 426. This feature is provided by having the outer surface 476 of pump control ring 424 being spaced apart from an inner wall 478 of housing 402. In particular, first cover 404 includes a stanchion 482 including an aperture 484 for receipt of pivot pin 426. Stanchion 482 is spaced apart from inner wall 478. Relatively low resistance to fluid discharge is encountered by incorporating this configuration.

In operation, pump 400 may be configured to operate in at least two different modes. In each of the modes of operation, first chamber 460 is provided pressurized fluid at pump outlet pressure. In a first mode of operation, second chamber 462 may be selectively supplied pressurized fluid from any source of pressure through the use of an on/off solenoid valve. In this first operation mode, an upper equilibrium pressure of pump 400 is defined by the pump outlet pressure and a lower equilibrium pressure may be defined by the second source.

In a second mode of operation, pump 400 may be associated with a proportional solenoid valve which may be operable to continuously vary the pressure to second chamber 462 and allow intermediate equilibrium pressures. As such, pump 400 operates at an infinite number of equilibrium pressures and not only the two fixed pressures as provided in the first arrangement.

FIGS. 9-11 depict another alternate variable displacement pump at reference numeral 500. Pump 500 may form a portion of a lubrication system 502 useful for supplying pressurized lubricant to an engine, transmission or other vehicle power transfer mechanism. Lubrication system 502 includes a reservoir 504 providing fluid to an inlet pipe 506 in fluid communication with an inlet 508 of pump 500. An outlet 510 of pump 500 provides pressurized fluid to a cooler 512, a filter 514 and a main gallery 516. Pressurized fluid travelling through main gallery 516 is supplied to the component to be lubricated, such as an internal combustion engine. Pressurized fluid is also provided to a feedback line 518. Feedback line 518 is in direct communication with a first control chamber 520 of pump 500. A solenoid valve 522 acts to control the fluid communication between feedback line 518 and a second control chamber 524.

Pump 500 is similar to pump 400 regarding the use of a pivoting pump control ring 526, first through fourth seal assemblies 528, 530, 532, 534, a bias spring 536, vanes 538, a rotor 540, a rotor shaft 542 and retaining rings 544. Similar elements will not be described in detail.

First seal assembly 528 and second seal assembly 530 act in concert with an outer surface 546 of control ring 526 and a cavity wall 548 to at least partially define first control chamber 520. Second control chamber 524 extends between second seal assembly 530 and third seal assembly 532 as well as between outer surface 546 and cavity wall 548. An outlet passage 550 extends between first seal assembly 528 and fourth seal assembly 534. A stanchion 554 includes an aperture 556 in receipt of a pivot pin 558 to couple control ring 526 for rotation with stanchion 554. As previously described in relation to pump 400, the enlarged outlet passage 550 substantially reduces restriction to pressurized fluid exiting pump 500. In yet another alternate arrangement not depicted, pivot pin 558 may provide a sealing function and allow removal of fourth seal assembly 534.

First seal assembly 528 is positioned at a first distance from a center of pivot pin 558 to define a first moment arm $R_1$. In similar fashion, a moment arm $R_2$ is defined by the position of fourth seal assembly 534 in relation to pivot pin 558. If moment arm lengths $R_1$ and $R_2$ are set to be equal, the pressure within outlet passage 550 provides no contribution to pressure regulation. On the other hand, moment arms $R_1$ and $R_2$ may be designed to be unequal if a permanent contribution from the pump outlet pressure is desired. As such, outlet passage 550 may function as a third control chamber. For example, it may be beneficial to provide a pressure regulation at a vehicle cold start condition. At cold start, it may be desirable to urge control ring 526 toward a position of minimum displacement as shown in FIG. 11. This may be accomplished by having moment arm $R_1$ be longer than moment arm $R_2$. Alternatively, it may be desirable to compensate for forces acting internally within pump 500 and acting on pump control ring 526. To address this concern, it may be desirable to construct moment arm $R_1$ at a length less than the length of moment arm $R_2$ to urge pump control ring 526 toward the maximum displacement position. FIG. 9 represents control ring 526 at a position of maximum eccentricity, thereby providing maximum pump displacement. For the pump depicted in FIGS. 9-11, first seal assembly 528 is circumferentially spaced apart from fourth seal assembly 534 an angle greater than 80 degrees.

In operation, first control chamber 520 is always active and may be in receipt of pressurized fluid from any source, such as the pump output. Second control chamber 524 is switched on and off via solenoid 522. The supply of pressurized fluid may be from any source. Outlet passage 550, or third control chamber 550, may or may not contribute to the pressure controlling function as described in relation to the relative lengths of moment arms $R_1$ and $R_2$.

Pump 500 need only be associated with an on/off type solenoid valve 522 due to the provision of three control chambers. Third control chamber 550 provides for a very low restriction outlet flow path. First control chamber 520 and second control chamber 524 allow two equilibrium pressures that are determined by sources other than the pump outlet pressure.

The above-described embodiments of the disclosure are intended to be examples of the present disclosure and alterations and modifications may be effected thereto, by those of skill in the art, without departing from the scope of the disclosure which is defined solely by the claims appended hereto.

What is claimed is:

1. A variable capacity vane pump for an automobile including a drivetrain in receipt of a fluid pressurized by the pump, the pump comprising:

a pump housing;

a pump control ring including a cavity and positioned within the housing to move about a pivot;

a vane pump rotor positioned within the cavity of the pump control ring, wherein a position of the pump control ring determines an offset between a center of the pump control ring cavity and an axis of rotation of the vane pump rotor;

vanes being driven by the rotor and engaging a surface of the pump control ring that surrounds the cavity, the vanes and the surface at least partially defining working fluid chambers;

a first control chamber between the pump housing and a first outer surface of the pump control ring, the first outer surface of the pump control ring being positioned on an opposite side of the pump control ring as the working fluid chambers, the first control chamber operable to receive pressurized fluid to create a force to move the pump control ring to reduce a volumetric capacity of the pump;

a second control chamber between the pump housing and a second outer surface of the pump control ring, the second outer surface of the pump control ring being positioned on an opposite side of the pump control ring as the working fluid chambers, the second control chamber operable to receive pressurized fluid to create a force to move the pump control ring to reduce the volumetric capacity of the pump; and a return spring biasing the pump control ring toward a position of maximum volumetric capacity, the return spring acting against the forces created by the pressurized fluid within the first and second control chambers.

2. The variable capacity vane pump of claim 1, wherein the drivetrain includes an engine.

3. The variable capacity vane pump of claim 1, wherein the pivot includes a pin fixed to the housing, wherein a portion of the pump control ring includes a curved surface engaging a portion of the pin.

4. The variable capacity vane pump of claim 3, wherein a different portion of the pin engages a curved surface of the housing.

5. The variable capacity vane pump of claim 4, wherein the pump control ring, the pin and the housing form a seal for one of the first and second control chambers.

6. The variable capacity vane pump of claim 1, wherein the vanes are slidably positioned within radially extending slots in the vane pump rotor.

7. The variable capacity vane pump of claim 1, wherein the cavity of the pump control ring includes a circular cylindrical shape.

8. The variable capacity vane pump of claim 1, wherein the pump control ring includes a curved wall comprising the surface that surrounds the cavity, the first outer surface and the second outer surface.

* * * * *